United States Patent [19]

Gardiner

[11] 4,181,094

[45] Jan. 1, 1980

[54] EXCESS DEVELOPER REMOVAL APPARATUS

[75] Inventor: Kenneth W. Gardiner, Menlo Park, Calif.

[73] Assignee: Savin Corporation, Valhalla, N.Y.

[21] Appl. No.: 881,199

[22] Filed: Feb. 27, 1978

Related U.S. Application Data

[63] Continuation of Ser. No. 766,068, Feb. 7, 1977, abandoned.

[51] Int. Cl.[2] ..... G03G 15/00

[52] U.S. Cl. ..... 118/652; 118/660; 118/DIG. 23; 355/15; 118/63

[58] Field of Search ..... 118/652, 660, DIG. 23, 118/63; 427/15, 17

[56] References Cited

U.S. PATENT DOCUMENTS

| | | | |
|---|---|---|---|
| 3,196,832 | 7/1965 | Zin | 118/660 |
| 3,392,706 | 7/1968 | Lloyd | 427/15 |
| 3,424,126 | 1/1969 | Mahoney | 118/652 |
| 3,741,157 | 6/1973 | Krause | 118/652 |
| 3,741,643 | 6/1973 | Smith et al. | 118/DIG. 23 |
| 3,942,889 | 3/1976 | Kurita et al. | 118/652 |

*Primary Examiner*—Roland E. Martin, Jr.
*Assistant Examiner*—John Goodrow
*Attorney, Agent, or Firm*—Shenier & O'Connor

[57] ABSTRACT

Apparatus for removing excess developer liquid from the surface of a photoconductor carrying a layer of developer liquid of a predetermined thickness in which a mechanical barrier extending across the photoconductive surface is positioned at a distance from the photoconductor surface which is less than said predetermined thickness, in which the surface and the mechanical barrier move relative to each other so that the mechanical barrier has a trailing portion with reference to the direction of relative movement, and in which a low-pressure air barrier is provided in the region of adjacency of the surface and the mechanical barrier to inhibit wetting of the trailing portion of the latter by the developer liquid.

26 Claims, 4 Drawing Figures

Fig 2
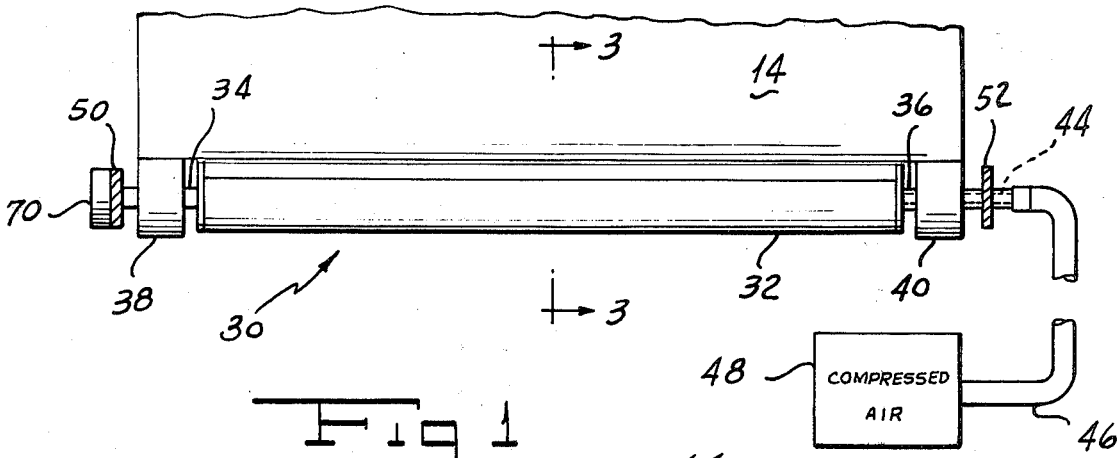
Fig 1
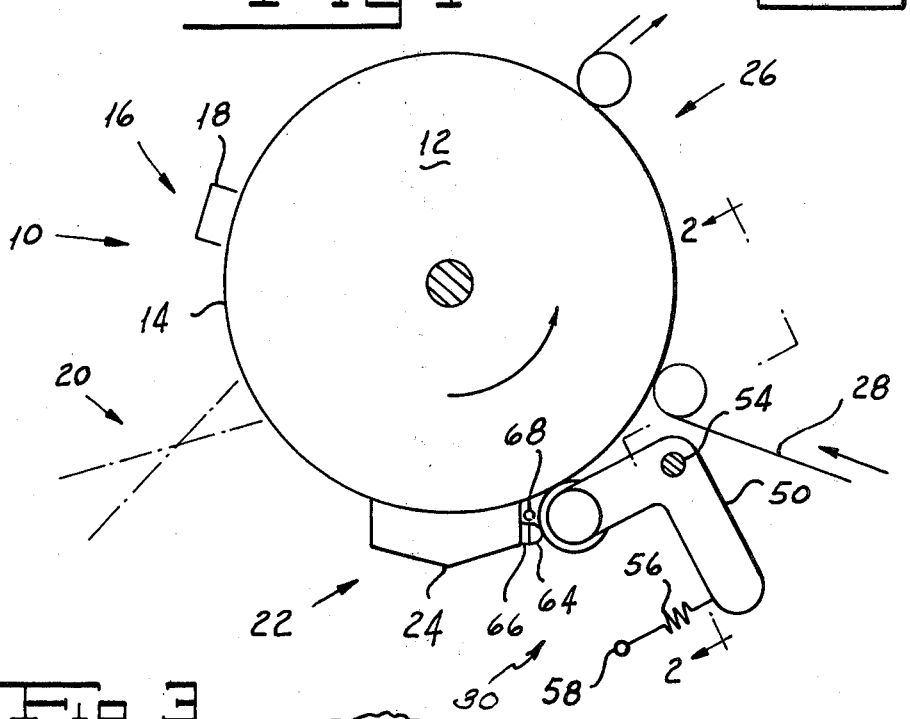
Fig 3
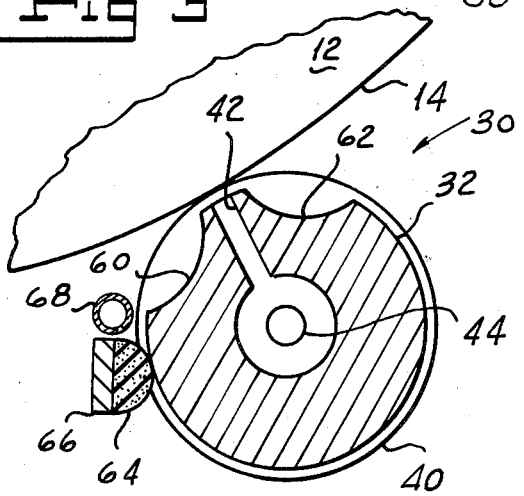
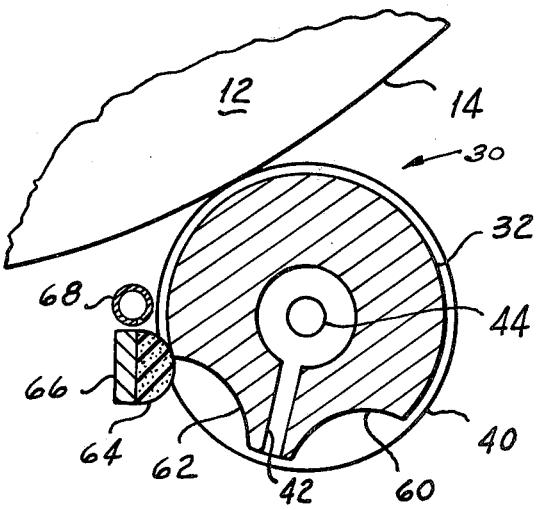
Fig 4

EXCESS DEVELOPER REMOVAL APPARATUS

This is a continuation application Ser. No. 766,068, filed Feb. 7, 1977, now abandoned.

BACKGROUND OF THE INVENTION

My invention relates to apparatus for removing excess liquid developer from the photoconductive surface of a plain paper electrophotographic copier.

It is necessary in plain paper electrophotographic copiers to remove most of the layer of liquid developer formed on the photoconductive surface during development, if damp or stained plain paper copies are to be voided. The removal must be performed without disturbing the delicate developed toner image on the photoconductive surface. Various techniques have been used in the prior art in attempts to accomplish this removal.

One system of the prior art includes a doctor blade in closely spaced relation to the photoconductor surface followed by a corona wire which generates an electrostatic field to provide a non-mechanical cleaning action. This arrangement has not proved satisfactory for that it does not reduce the liquid level sufficiently. As a result, high heat is required to dry the copies resulting in a high level of developer liquid carrier fumes in the region of the copier.

According to another technique of the prior art, an elongated high-velocity air jet is directed from an air knife to effect removal of the excess developer under the action of the air jet. Since this technique requires a relatively high-volume-velocity air stream, a considerable amount of developer liquid is vaporized. If pollution of the surrounding region is to be avoided, the resultant fumes must be collected and carried away by bulky supporting systems.

U.S. Pat. No. 3,907,423, issued to Hayashi et al, discloses an arrangement in which a closely spaced roller disposed across the photoconductive surface is rotated at a high speed in a direction opposite to that of the surface. While this technique is generally satisfactory, the multiplicity of moving parts makes the system undesirably complex.

SUMMARY OF THE INVENTION

One of the objects of my invention is to provide an apparatus for removing excess liquid developer which does not disturb the developed image.

Another object of my invention is to provide an apparatus for removing excess liquid developer which does not create an excess amount of fumes.

A further object of my invention is to provide an apparatus for removing excess liquid developer which does not require bulky auxiliary systems.

Still another object of my invention is to provide an apparatus for removing excess liquid developer which is mechanically simple.

Other and further objects will be apparent from the following description.

In general, my invention contemplates an apparatus for removing excess liquid developer from a photoconductive surface in which a mechanical barrier member formed with a narrow slot extending across the photoconductive surface is supported in closely spaced relationship to the surface with a gap between the barrier and the surface which is substantially less than the thickness of the developer layer. Low-pressure air supplied to the slot from inside the barrier forms a low-pressure air barrier which assists in effectively removing nearly all of the developer liquid without disturbing the toner image. Preferably, the barrier member is supported in this manner by suitably biasing rollers rotatably attached to the ends of the barrier member against the photoconductive surface. By so positioning the member relative to the photoconductive surface, substantially all of the developer layer can be removed using only a minimal amount of air pressure and with very little air volume. Vaporization of the liquid developer is only a small fraction of that produced by air knife assemblies of the prior art, and air pollution is thus substantially eliminated.

BRIEF DESCRIPTION OF THE DRAWINGS

FIG. 1 is a side elevation of an electrophotographic copier, incorporating one embodiment of my apparatus.

FIG. 2 is a fragmentary view of the apparatus taken along line 2—2 of FIG. 1, with parts removed.

FIG. 3 is an enlarged section of the apparatus, taken along line 3—3 of FIG. 2.

FIG. 4 is an enlarged section of the apparatus shown in FIG. 1 in its inoperative position.

DETAILED DESCRIPTION OF THE PREFERRED EMBODIMENT

Referring to the drawings, an electrophotographic copier 10 incorporating my excess developer removal apparatus includes a drum 12 having a photoconductive surface 14 which is rotated in the direction shown past a plurality of processing stations. More particularly, the drum 12 rotates past a charging station 16 at which a corona charger 18 provides the drum surface 14 with a uniform electrostatic charge, an exposure station 20 at which the surface 14 is exposed to a light image of an original selectively to discharge the surface and form an electrostatic image, a developing station 22 at which a liquid developer is applied to the surface from a developing tank 24 to form a visible toner particle image on the surface 14, and a transfer station 126 at which the developed image is transferred to a sheet 28 of plain paper. Preferably, the copier 10 also includes a cleaning station (not shown) between the transfer station and the charging station 16, at which accumulated toner deposits are removed from the drum surface 14.

The excess developer removal apparatus, indicated generally by the reference numeral 30, is located on the drum periphery immediately following the developing tank 24 in the direction of movement of the drum 12. The apparatus 30 comprising a hollow, generally cylindrical member 32, the ends of which receive stub shafts 34 and 36. Shafts 34 and 36 rotatably support rollers 38 and 40 which engage the drum surface 14 near its lateral edges. Rollers 38 and 40 are formed with a slightly greater diameter than that of the member 32 to provide a gap between the member 32 and the drum surface 14 of about 0.002 inch. After passing through the developing station 22, the surface 14 typically carries a film of developer which is about 0.012 inch thick. Thus member 32 acts as a mechanical barrier to the passage of a film of this thickness. While member 32 provides a mechanical barrier to the passage of the relatively thick layer of developer liquid, I have discovered that some means must be provided for preventing wetting of the trailing portion of the member 32 following the point of closest proximity of the member 32 to the surface 14. If this is not done and the trailing portion is wet with developer liquid, large drops of liquid are left on the photoconductive surface 14 as the surface tension film of liquid developer along the trailing portion of the barrier member 32 and the surface 14 is broken loose.

I form the member 32 with an axially extending exit slit 42 communicating with the hollow interior of member 32. Preferably, the width of the exit slit 42 is five to ten times the gap between the member 32 and the drum surface 14, or about 0.02 inch. Tubing 46 feeds compressed air from a supply 48 to a bore 44 formed in the shaft 36 and leading into the interior of member 32. Preferably, the air supply 48 provides air at a pressure between 5 and 10 inches of water. The member 32 is preferably formed with axially extending grooves 60 and 62 on the outer surface adjacent to the edges of the slit 42 to provide a well-defined region of adjacency and to reduce turbulence.

The narrow spacing between the slit 42 and the surface 14 and the slight positive pressure in the region between the member 32 and the surface 14 cooperate to form an effective air barrier which breaks the surface tension of the liquid between drum 12 and member 32 to prevent wetting of the trailing portion of member 32. This is accomplished without disturbing the developed image. My arrangement requires only a low volume of air of from about 2 to about 4 cubic feet per minute.

A pair of pivot members 50 and 52, arms of which rotatably receive the stub shafts 34 and 36, support barrier member 32 in its operating position. Each of the pivot members 50 and 52 pivots upon a pivot shaft 54 and is suitably biased by means of a spring 56 attached between an arm of the pivot member and a fixed point 58. Springs 56 bias the rollers 38 and 40 against the drum 12 so that the barrier member 32 remains a fixed distance from the drum 12 despite any eccentricity or surface irregularity of the drum 12.

It will be appreciated that, in the course of an operating cycle, some wetting of member 32 in and adjacent to the area of the slit 42 occurs. To remove such developer and to prevent buildup of toner deposits in these areas, after each machine use period, I wipe the slit area of member 32 with an elongated spongy pad 64 carried by a supporting member 66 at a location spaced away from the drum surface 14. Preferably, an elongated perforated tubing 68 supplies the spongy pad 64 with developer liquid to keep it wet.

A rotary solenoid 70 mounted on pivot member 50 and coupled to stub shaft 34 is energized during a machine use period to maintain the member 32 in the position shown in FIG. 3, in which the exit slit 42 is adjacent to the drum surface 14. At the end of a machine use period, solenoid 70 is de-energized to permit the exit slit 42 of the member 32 to rotate counterclockwise past the sponge 42 to the downwardly facing position shown in FIG. 4. As the exit slit 42 moves past the pad 64, liquid developer is wiped off. At the beginning of the next machine use period, solenoid 70 is again energized to rotate the barrier member clockwise to its operative position with the exit slit 42 adjacent to the drum surface 14.

It will be seen that I have accomplished the objects of my invention. My apparatus removes excess liquid toner without disturbing the developed toner image. My apparatus does not create an excess amount of fumes, nor does it require bulky auxiliary support systems. Finally, it is mechanically simple.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. Apparatus for removing excess developer liquid from a moving image-bearing surface carrying a layer of liquid developer of a certain thickness including, in combination:

an elongated barrier member;

means for mounting said barrier member with the length thereof extending across the portion of said surface bearing said image, with a substantially unpressurized region immediately in advance of the leading portion of said barrier member and adjacent to said developer layer, and with a spacing between the leading portion of said barrier member and said surface which is less than the thickness of said developer layer to intercept said layer; and means for forming an air curtain behind the leading portion of said barrier member in the region of adjacency of said member and said surface.

2. Apparatus as in claim 1 in which said air curtain forming means comprises means for forming a transverse slit in said barrier member between the leading and trailing portions and means for maintaining the interior of said slit at a pressure greater than atmospheric pressure.

3. Apparatus as in claim 2 in which said pressure maintaining means maintains the interior of said slit at a pressure from 5 to 10 inches of water greater than atmospheric pressure.

4. Apparatus as in claim 2 in which said pressure maintaining means supplies the interior of said slit with air at a rate between 2 and 4 cubic feet per minute.

5. Apparatus as in claim 2 in which the width of said slit is substantially greater than the spacing of said barrier member from said surface.

6. Apparatus as in claim 2 in which the width of said slit is 5 to 10 times the spacing of said barrier member from said surface.

7. Apparatus as in claim 6 in which the width of said slit is 0.02 inch.

8. Apparatus as in claim 2 in which the leading and trailing portions of said barrier member are generally parallel to the image-bearing surface.

9. Apparatus as in claim 1 in which said mounting means comprises a pair of rollers rotatably attached to the barrier member at opposite ends thereof, and means for biasing the rollers against the image-bearing surface.

10. Apparatus as in claim 1 in which the spacing between the barrier member and the leading portion of said image-bearing surface is between 0.001 and 0.002 inch.

11. Apparatus as in claim 1, further including means spaced away from the image-bearing surface for cleaning the portions of said barrier member adjacent to the image-bearing surface, said mounting means comprising means for moving said portions to the cleaning means.

12. Apparatus as in claim 1 in which said barrier member and air curtain forming means comprise:

a generally cylindrical member having a hollow interior and an axially extending exit slit communicating with said interior and having an axially extending groove formed in the outer surface along each side of the exit slit; and means for maintaining said interior at a pressure greater than atmospheric pressure.

13. Apparatus for removing excess developer liquid from an image-bearing surface carrying a layer of liquid developer of a certain thickness including, in combination:

a mechanical barrier member extending across said surface;

means mounting said member in spaced relationship to said surface with a spacing between said barrier and said surface which is less than said certain thickness;

means for moving said surface and said barrier member relative to each other whereby said barrier member has a trailing portion with reference to the direction of said relative movement;

means forming a relatively low-pressure air barrier in the region of adjacency of the barrier member and said surface to inhibit wetting of said trailing portion of said barrier member by said developer liquid; and means spaced away from said image-bearing surface for cleaning the portions of said barrier member adjacent to the image-bearing surface, said mounting means comprising means for moving said portions to the cleaning means.

14. Apparatus as in claim 13 in which said cleaning means comprises a spongy pad.

15. Apparatus as in claim 13 in which the moving means rotates the barrier member on the axis of said rollers.

16. Apparatus for removing excess developer liquid from a moving image-bearing surface carrying a layer of liquid developer of a certain thickness including, in combination:

a mechanical barrier member extending across said surface and having leading and trailing portions relative to the direction of movement of said surface, said leading and trailing portions being spaced from one another to form a transverse slit;

means mounting said member in spaced relationship to said surface with a spacing between said barrier member and said surface which is substantially less than said predetermined thickness, said slit having a width substantially greater than the spacing of said member from said surface; and means for maintaining the interior of said slit at a pressure slightly greater than atmospheric pressure to form a relatively low-pressure air barrier in the region of adjacency of the barrier member and said surface to inhibit wetting of said trailing portion of said barrier member by said developer liquid.

17. In a copying machine in which a surface bearing a latent electrostatic image is developed by applying liquid developer to the surface at a developing station and is then moved with a relatively thin adhering developer layer to an excess developer removal station, apparatus at said removal station including, in combination:

an elongated barrier member;

means for mounting said barrier member with the length thereof extending across the portion of said surface bearing said image, with a region immediately in advance of said leading portion of said barrier member in which said developer layer is directly exposed to the ambient atmosphere, and with a spacing between the leading portion of said barrier member and said surface which is less than the thickness of said developer layer to intercept said layer; and means for forming an air curtain behind the leading portion of said barrier member in the region of adjacency of said member and said surface.

18. Apparatus for removing excess developer liquid from a moving image-bearing surface carrying a layer of liquid developer of a certain thickness including, in combination:

an elongated edge;

means for mounting said edge with the length thereof extending across the portion of said surface bearing said image with a spacing between said edge and said surface which is less than the thickness of said developer layer to intercept said layer, the region of adjacency of said surface and said edge having no substantial extent in the direction of surface movement; and means for creating a pressurized region immediately behind said edge to form an air curtain in the region of adjacency of said edge and said edge and said surface.

19. Apparatus for removing excess developer liquid from an image-bearing surface carrying a layer of liquid developer of a certain thickness including, in combination:

a mechanical barrier member extending across said surface;

means mounting said member in spaced relationship to said surface with a spacing between said barrier member and said surface which is less than said certain thickness;

means for moving said surface and said barrier member relative to each other whereby said barrier member has a leading portion and a trailing portion with reference to the direction of said relative movement; and means for forming a relatively low-pressure air barrier in the region of adjacency of the barrier member and said surface to inhibit wetting of said trailing portion of said barrier member by said developer liquid, said air barrier means comprising means for forming a transverse slit in said barrier member between said leading and trailing portions and means for maintaining the interior of said slit at a pressure greater than atmospheric pressure, said pressure maintaining means maintaining the interior of said slit at a pressure from 5 to 10 inches of water greater than atmospheric pressure.

20. Apparatus for removing excess developer liquid form an image-bearing surface carrying a layer of liquid developer of a certain thickness including, in combination:

a mechanical barrier member extending across said surface;

means mounting said member in spaced relationship to said surface with a spacing between said barrier member and said surface which is less than said certain thickness;

means for moving said surface and said barrier member relative to each other whereby said barrier member has a leading portion and a trailing portion with reference to the direction of said relative movement; and means for forming a relatively low-pressure air barrier in the region of adjacency of the barrier member and said surface to inhibit wetting of said trailing portion of said member by said developer liquid, said air barrier forming means comprising means for forming a transverse slit in said barrier member between said leading and trailing portions and means for maintaining the interior of said slit at a pressure greater than atmospheric pressure, said pressure maintaining means supplying the interior of said slit with air at a rate between 2 and 4 cubic feet per minute.

21. Apparatus for removing excess developer liquid from an image-bearing surface carrying a layer of liquid developer of a certain thickness including, in combination:

a mechanical barrier member extending across said surface;

means mounting said member in spaced relationship to said surface with a spacing between said barrier member and said surface which is less than said certain thickness, said mounting means comprising a pair of rollers rotatably attached to the barrier member at opposite ends thereof and means for biasing the rollers against the image-bearing surface;

means for moving said surface and said barrier member relative to each other whereby said barrier member has a trailing portion with reference to the direction of said relative movement; and means for forming a relatively low-pressure air barrier in the region of adjacency of the barrier member and said surface to inhibit wetting of said trailing portion of said barrier member by said developer liquid.

22. Apparatus for removing excess developer liquid from a moving image-bearing surface carrying a layer of liquid developer of a certain thickness including, in combination:

an elongated barrier member;

means for mounting said barrier member with the length thereof extending across the portion of said surface bearing said image and with a spacing between the leading portion of said barrier member and said surface which is between 0.001 and 0.002 inch; and means for forming an air curtain behind the leading portion of said barrier member, the region adjacent to said developer layer and the leading portion of said barrier member being substantially unpressurized to permit relatively unrestricted flow of air toward the leading portion of said barrier member.

23. Apparatus for removing excess developer liquid from a moving image-bearing surface carrying a layer of liquid developer of a certain thickness including, in combination:

a generally cylindrical member having a hollow interior and an axially extending exit slit communicating with said interior and having an axially extending groove formed in the outer surface along each side of the exit slit;

means for mounting said member with the length thereof extending across the portion of said surface bearing said image and with a spacing between said exit slit and said surface which is less than the thickness of said developer layer to intercept said layer; and means for maintaining said interior at a pressure greater than atmospheric pressure to form an air curtain behind the leading portion of said member, the region adjacent to said developer layer and the leading portion of said member being substantially unpressurized to permit relatively unrestricted flow of air from said exit slit toward the leading portion of said member.

24. Apparatus as in claim 18, further including a second edge spaced behind said first edge, said air curtain means creating a pressurized region between said first edge and said second edge.

25. Apparatus as in claim 18 in which said developer layer is directly exposed to the ambient atmosphere in the region immediately in advance of the leading portion of said edge.

26. Apparatus as in claim 18 in which said first edge has a substantially unpressurized region immediately in advance of the leading portion thereof and adjacent to the developer layer.

* * * * *